United States Patent [19]

Rosenblad

[11] Patent Number: 4,969,507

[45] Date of Patent: Nov. 13, 1990

[54] INTEGRAL BLOW DOWN CONCENTRATOR WITH AIR-COOLED SURFACE CONDENSER

[76] Inventor: Axel E. Rosenblad, 1566 Ocean Blvd., Seabright, N.J. 07760

[21] Appl. No.: 397,725

[22] Filed: Aug. 23, 1989

[51] Int. Cl.[5] ..... B01D 51/00

[52] U.S. Cl. ..... 165/1; 165/111; 165/115; 165/170; 165/914

[58] Field of Search ..... 165/111, 115, 914, 170; 159/13.1, 13.3, 28.6, 49

[56] References Cited

U.S. PATENT DOCUMENTS

| | | | |
|---|---|---|---|
| 3,332,469 | 7/1967 | Rosenblad | 165/115 X |
| 3,351,119 | 11/1967 | Rosenblad | 165/115 X |
| 3,371,709 | 3/1968 | Rosenblad | 165/115 |
| 3,502,140 | 3/1970 | Dawson | 159/13.1 X |
| 4,216,002 | 8/1980 | Rosenblad | 159/13.3 X |

*Primary Examiner*—Robert G. Nilson
*Attorney, Agent, or Firm*—Brooks Haidt Haffner & Delahunty

[57] ABSTRACT

An evaporative condenser of the plate type having spaced heat exchange elements incorporates a blow down concentrator. Vapor enters the elements and after condensation therein by heat exchange with liquid flowing as a film on the outer surfaces of the elements; condensate is discharged from the bottoms of the elements. The coolant liquid is itself evaporatively cooled by a flow of cooling air passing outside the heat exchange elements, within a casing that encloses the elements. The cooling air may even be warmer than the coolant liquid so long as the air is not saturated. The overflow of cooling water from the condenser elements goes to the concentrator section, thus eliminating a separate piece of equipment especially dedicated to the concentrating of used coolant.

9 Claims, 12 Drawing Sheets

INTEGRAL BLOW DOWN CONCENTRATOR WITH AIR-COOLED SURFACE CONDENSER

BACKGROUND OF THE INVENTION

1. Field of the Invention

The invention relates to plate-type falling film condensers which incorporate a blow down concentrator.

2. Discussion of the Prior Art

Plate-type falling film heat exchangers are highly effective and are widely used in various industries. Heat exchangers of this type have been disclosed in U.S. Pat. Nos. 3,332,469; 3,351,119; 3,366,158 and 3,371,709. Heat exchange elements made up of pairs of plates secured together around their edges and having opposed dimples to strengthen the element against deformation are described in U.S. Pat. No. 3,512,239 which discloses a method of making such elements.

Falling film heat exchangers are used as evaporators to vaporize liquid flowing as a film or as condensers to liquify steam or other vapor by the transfer of heat therefrom to a falling liquid film. In an evaporator the heating of the liquid is the desired result. In a condenser the heating of the liquid is an unavoidable consequence of the transfer of heat from the condensing vapor. The heating of the coolant liquid in condensers and the consequent loss of its ability to cool has been tolerated in the past.

An evaporative condenser which condenses vapor such as steam by evaporative cooling uses a circulating coolant medium, usually water. As the water circulates, it not only gets warmer but also develops an increasing concentration of dissolved solids.

Some of the circulating water can be replaced with fresh make-up water as some of the water carrying the dissolved solids is removed as waste to a sewer or the like, keeping the circulating water of good enough quality to avoid scaling and deposits on the heating surface, but environmental considerations have made disposal of the solids-bearing waste water troublesome. In many cases this waste water goes to a separate evaporator where it is concentrated to the point where it can be used as landfill.

SUMMARY OF THE INVENTION

The present invention is directed to improving the performance of falling film condensers by providing means for cooling the flowing film of liquid. An integral blown down concentrator serves to concentrate the coolant after it has served its cooling function. While the falling film is accepting heat transferred from the vapor being condensed within a heat exchange element, the liquid is itself evaporatively cooled by the flow of cooling air past the outer surface of the liquid. Thus the falling film of liquid acts as a heat exchange medium for the vapor being condensed, and the air flowing past the falling film acts as a heat exchange medium to cool the liquid. The blow down concentrator can be similar in structure to the other air-cooled surface condenser elements of the apparatus.

A plurality of spaced parallel heat exchange elements, including one or more working as a concentrator for coolant, are arranged within a housing. Each heat exchange element is formed of a pair of spaced, flat plates joined at their peripheries. The heat exchange elements have top openings connected to a header conduit for the entry or exit of vapor and have bottom openings connected to a pipe for discharge of condensate. In a modified embodiment of the invention, the heat exchange elements are arranged radially; that is upright heat exchange elements extend outward like spokes of a wheel, part of which can be a concentrator.

In the parallel plate arrangement, cooling liquid enters the housing through a pipe wich leads to an overflow box within a distribution box spaced above the heat exchange elements. When liquid fills the box it overflows onto a perforated plate which distributes the liquid evenly over the heat exchanger elements to form the downward running film on the element surfaces. An outlet for the liquid is provided at the lower end of the housing or casing.

Near the bottom of the housing there can be a port for the admission of cooling air, which encounters the coolant liquid as the liquid falls as a shower from the lower ends of the heat exchange elements, thereby cooling the liquid. The air then will pass upward between the heat exchange elements in countercurrent flow to the coolant liquid, and the warmer saturated air will leave the housing at a point above the tops of the heat exchange elements.

Alternatively, the coolant air can be introduced through the sides of the housing, either near the bottom or near the top to flow countercurrently to the coolant liquid.

Non-condensed vapor, including noncondensible gases, can be vented from the interior spaces of the heat exchange elements along with the condensate, or separately. If the gases are to be vented along with the condensate, the vapor to be condensed is introduced through an upper header conduit. If the vent gases are to be separated from the condensate, the vapor to be condensed is admitted to the interior spaces of the heating elements through a bottom header which connects to the bottoms of the elements, or near their bottoms, to pass upward in countercurrrent flow to the coolant liquid, and the non-condensed gases are vented through a header near the element tops.

It is contemplated that the most common use of the system of the invention will be in the condensation of steam, using water as the coolant liquid and air as the coolant for the water, but clearly other gases and liquids can be condensed and used as coolants. When steam contains noxious constituents, the separate venting of non-condensed gases containing such noxious substances permits recovery of cleaner discharged condensate and facilitates subsequent treatment of the vent gases.

As in the case of the parallel heat exchange elements, the radial arrangement of heat exchange elements permits flow of the vapor, coolant liquid, and cooling air in any permutation of countercurrent and concurrent flows, though it is contemplated that the coolant liquid will always flow downward over the heat exchange surfaces of the elements as a falling film.

In some applications of the invention it is desirable to employ a fan to force the flow of cooling air past the heat exchange elements in contact with the coolant liquid flowing down the heat exchange surfaces.

It has been found that when the upward flow of air past the plate surfaces is rapid enough droplets of the coolant liquid detach themselves from the film falling down the plate surfaces. These droplets are entrained by the upward-flowing air and are suspended therein. This phenomenon significantly increases the heat transfer between the media in an unforeseen way, by creating a kind of fluidized bed. The droplets are not in the form of a mist, but are considerably larger, and their mass prevents them from being blown out from the top of the condenser, although some of the droplets fall to the bottom to be replaced by droplets newly detached from the falling film.

Advantageous arrangements for the distribution of coolant liquid to fall as a thin film down the heat exchange element surfaces in condensers according to the invention are described as being of a pipe or flat perforated plate-type.

One or more of the plate heat exchange elements is supplied with water which has passed over the surface of other condenser elements and has thus picked up a higher concentration of dissolved solids. It is desirable to further concentrate this water, and, since the evaporative condenser is a condenser, a portion of the heating surface (one or more heating elements) can serve to concentrate the liquid. Make up water in an equivalent quantity to the waste water is provided.

These and other applications and advantages of the system of the present invention will be more fully understood from the following detailed description of preferred embodiments, especially when that description is read with reference to the accompanying drawing.

BRIEF DESCRIPTION OF THE DRAWING

In the drawing, in which like reference characters indicate like parts throughout.

DETAILED DESCRIPTION OF PREFERRED EMBODIMENTS

Figure 1:
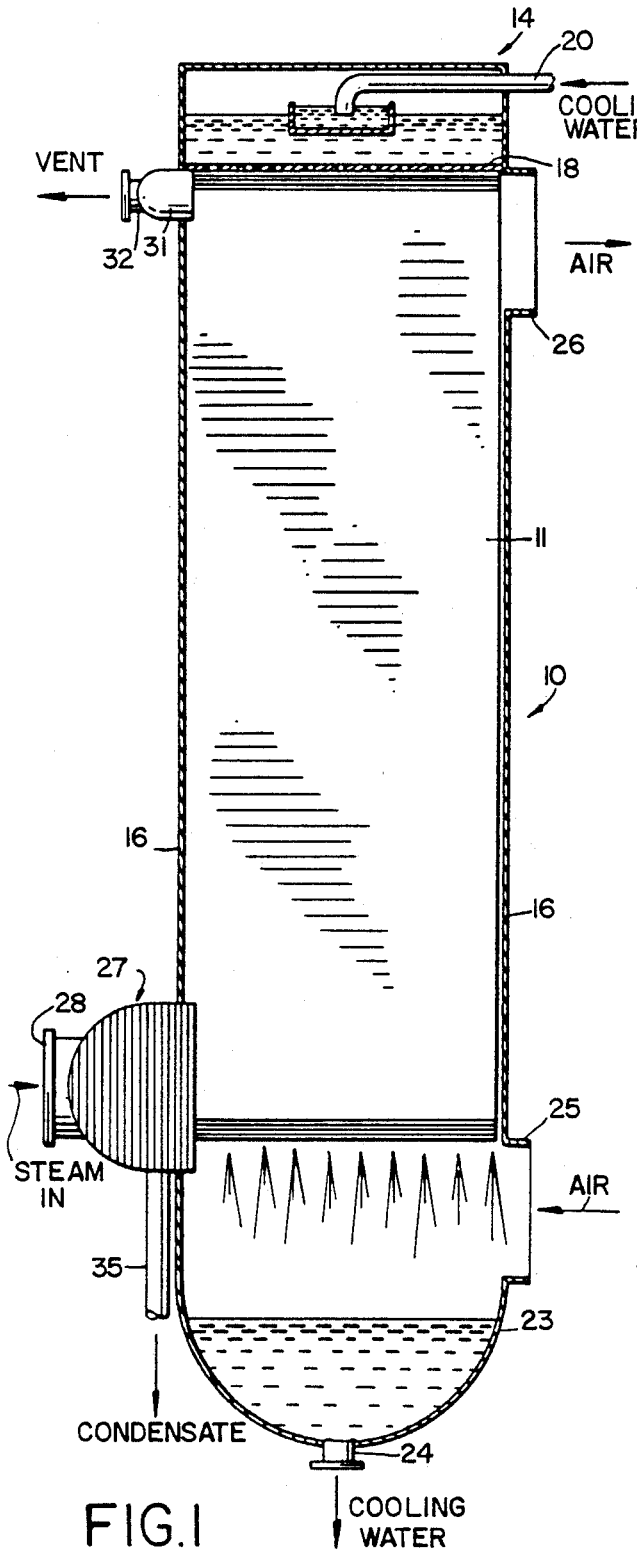
FIG. 1 shows a side cut away view of a condenser system according to the invention with a bottom side air inlet, bottom side vapor inlet and top side air outlet.

The several figures of the drawing illustrate presently preferred embodiments of a plate heat exchanger of the falling film type particularly effective for the condensing of steam. Arrows in the drawing figures show inlets for steam and cooling air and cooling water as well as outlets for vent gases, condensate and water. Thus in FIGS. 1 and 2, steam to be condensed enters at the lower part of the system, and cooling air also is admitted at the lower part, whereas vent gases and air exit near the top and condensate is withdrawn from the bottom part of the system. The arrangement of FIGS. 6 and 7 differs in that steam to be condensed enters near the top of the system and condensate and vent gases are drawn off together near the bottom; that is, steam and cooling water are in parallel flow. Each version of the system has its own advantages. The term "steam" as used throughout this discussion is used generally as a synonym for the word "vapor", but it should be understood that vapor other than water vapor could be condensed in accordance with the invention.

Figure 2:
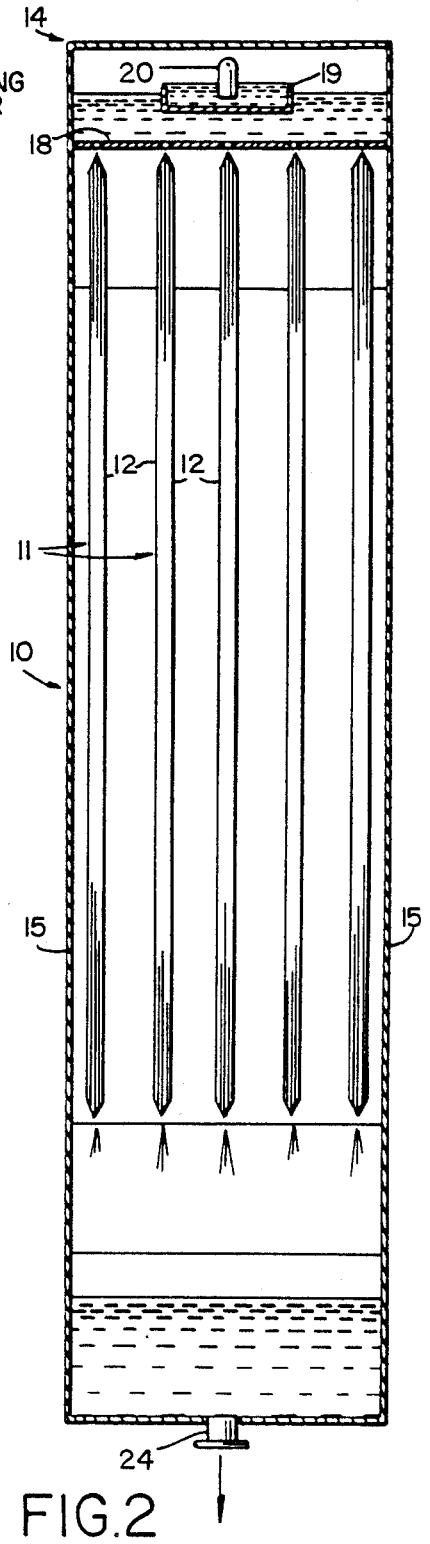
FIG. 2 is an end cut away view taken perpendicular to the view of the condenser of FIG. 1.

Referring now more particularly to the embodiment illustrated in FIGS. 1 and 2 it will be seen that the condenser apparatus generally designated 10 comprises a plurality of spaced, parallel vertically oriented heat exchange elements 11, each of which elements is composed of a pair of spaced parallel broad plates 12 secured together around the plate peripheries as by welding or other means to form enclosed spaces within the elements 11. The heating elements 11 are enclosed in a casing generally designated 14, having side walls 15 and end walls 16.

The heat exchange elements 11 can be of the type described in my prior U.S. Pat. No. 3,512,239, which discloses a method of manufacturing such elements.

The heat exchange elements 11 occupy the central portion of the space within the casing 14. Above the heat exchange elements 11 are means for introducing cooling water (or other cooling liquid) to flow down the vertical surfaces of the plates 12 as a thin film. For this purpose there is a perforated tray 18 within the upper portion of the casing, an open-topped box 19 spaced above the tray 18 and a water inlet pipe 20 passing through the casing wall 16 for delivery of cooling water.

The cooling water is fed to the box 19 and overflows out of the open top of the box 19 to distribute water to the perforated tray 18 more evenly than if the water simply poured out of the pipe 20 on to the tray 18. The water then flows through the perforated tray to distribute itself over the surfaces of the plates 12 and runs down the plates 12 as a thin film under the influence of gravity. The water falls from the lower ends of the heat exchange elements 11 as a shower. The lowest part of the casing 14 has inwardly and downwardly curved walls 23 to collect the cooling water and ending at an outlet nozzle 24 for exit of the used water.

As shown in FIG. 1 there is an inlet 25 for cooling air through the curved bottom wall 23 of the casing 14. Upon entry the cooling air passes through the shower of water falling from the element 11 and then passes upwards between the elements 11 in countercurrent flow to the direction of flow of the falling water film. Of course the elements 11 are spaced apart by a sufficient distance for free flow of the water film and cooling air. Having traversed the vertical length of the elements 11, the cooling air, carrying some evaporated water, exits through the conduit 26 that passes through the casing wall 16 below the water distribution tray 18 near the top ends of the elements 11.

Having described the casing 14 outside the heat exchange elements 11, the flow in the interior spaces of the elements 11, where condensation occurs, will be considered.

Figure 5:
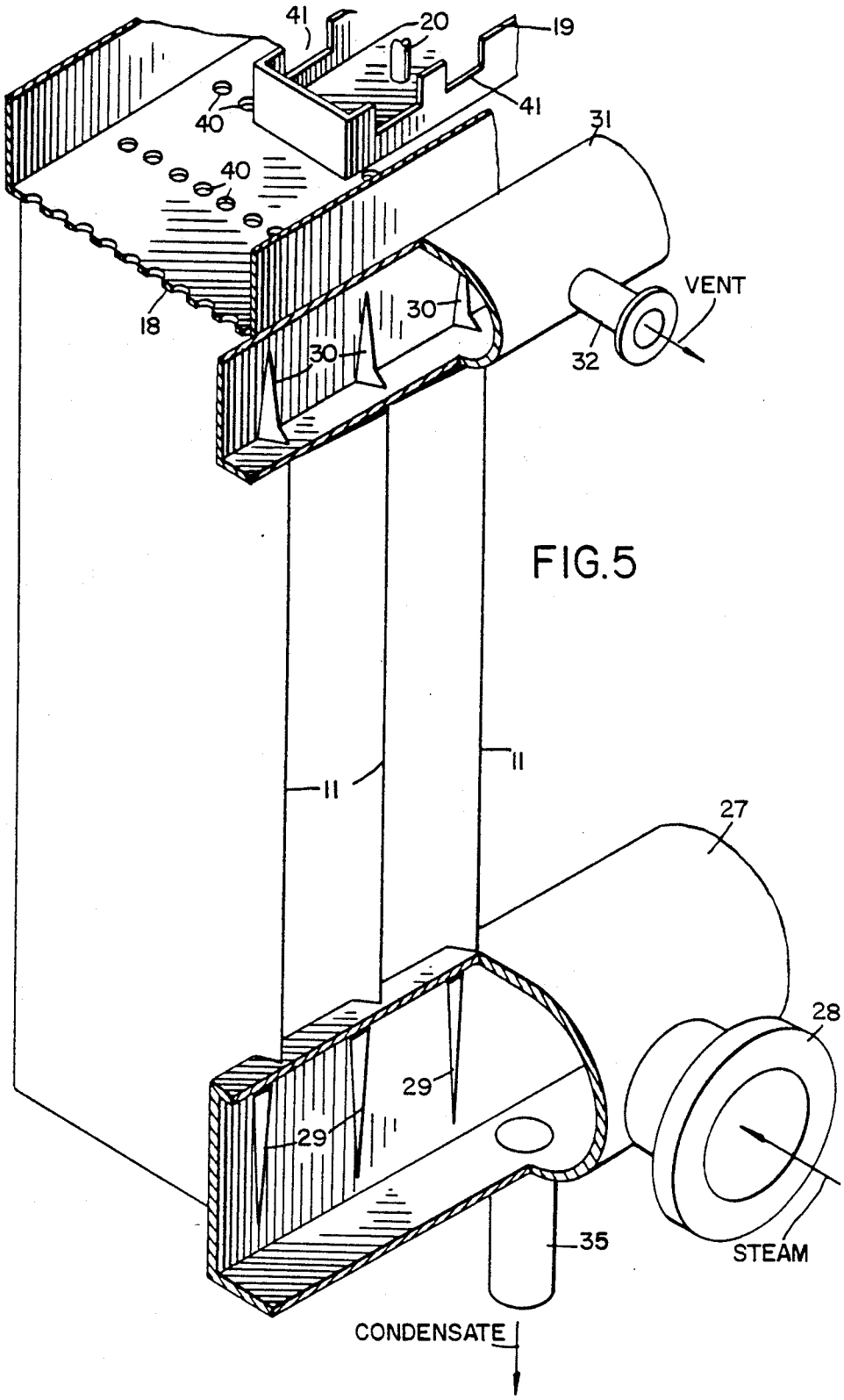
FIG. 5 is an isometric view of part of the system according to any one of FIGS. 1–4 with some parts broken away to show internal structure.

In the embodiment of FIGS. 1 and 2, steam enters the interior of the heat exchange elements 11 at the bottom of each element 11, through a bottom header generally designated by the reference numeral 27 on the opposite side of the casing 14 from the air inlet 25. The term "side" is used in this description and in the claims to mean the side walls 15 specifically and also more generally to mean all of the vertical walls 15 and 16 of the casing as distinguished from the bottom or top of the system. This bottom header 27 is fed with steam by a pipe 28 and distributes the steam through a series of slot-like openings 29 to the interior spaces of the heat exchange elements 11 as shown best in FIG. 5, showing how there is a generally Vee-shaped opening at the lower edge of each element 11 where the plates 12 thereof are not sealed together as they are elsewhere around their peripheries. The elements 11 have similar opened edge portions at 30 at their upper corners, opening on to an upper header 31 leading to the vent exhaust conduit 32. Steam accordingly travels upwards in the interior spaces formed within the elements 11.

The header 31 can be diagonally opposite from the location of the header 27, that is, these headers could open on to diagonally opposite corners of the elements 11, instead of being on the same side of the elements 11 as shown in FIGS. 1 and 2.

The hot steam, rising within the elements 11, is condensed (or cooled and condensed if superheated) by heat exchange through the plates 12 with the cooling water flowing down the outer surfaces of the plates 12. As the steam condenses on the inner surfaces of the plates 12, condensate runs down those surfaces. There is, of course, sufficient open space between the opposed inner plate surfaces to allow upward passage of steam while the condensate flows downward.

Vapor, plus some non-condensible gases that entered with the steam, are discharged through the upper header 31 and exhaust conduit 32 for such further treatment as may be necessary or desirable. The condensate is removed from the bottoms of the elements 11.

The transverse bottom header 27 also serves as a drainage pipe for withdrawal of the condensate and is shown to have a portion extending below the bottoms of the elements 11. For condensate drainage the header 27 is connected to an upstanding pipe section 35 that extends downward away from the casing 14 as shown in FIGS. 1 and 5. The condensate exits to the header 27 through the steam entry slots 29.

It will be understood that the heat lost by the steam in the condensation thereof is gained by the water of the falling film on the outer surfaces of the plates 12. Some water will evaporate to be carried off through the conduit 26. Thus the air entering at the lower part of the housing serves to cool the water effectively, and to increase the ability of the water to cool and condense steam within the elements 11. The water temperature will vary along the height of the plates 12 and will be related to the humidity of the cooling air. Thus the water will be cooler at the bottom of the elements 11 when there is a bottom air inlet as in FIGS. 1 and 2, since the air near the top of the elements 11 will be almost saturated in such a system.

Figure 3:
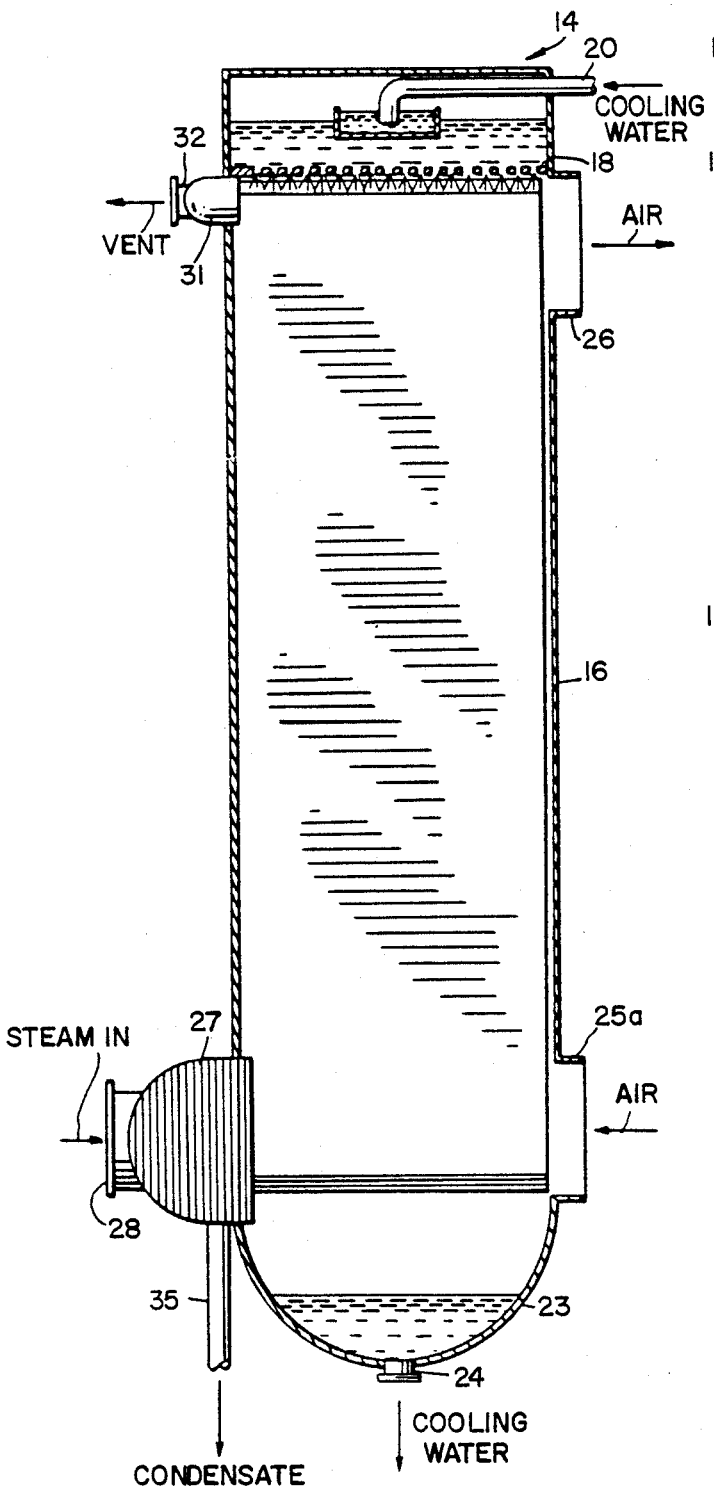
FIG. 3 is a view similar to that of FIG. 1 of a condenser system like that of FIGS. 1 and 2 except that the side air inlet is located above the bottoms of the heat exchange elements.
Figure 4:
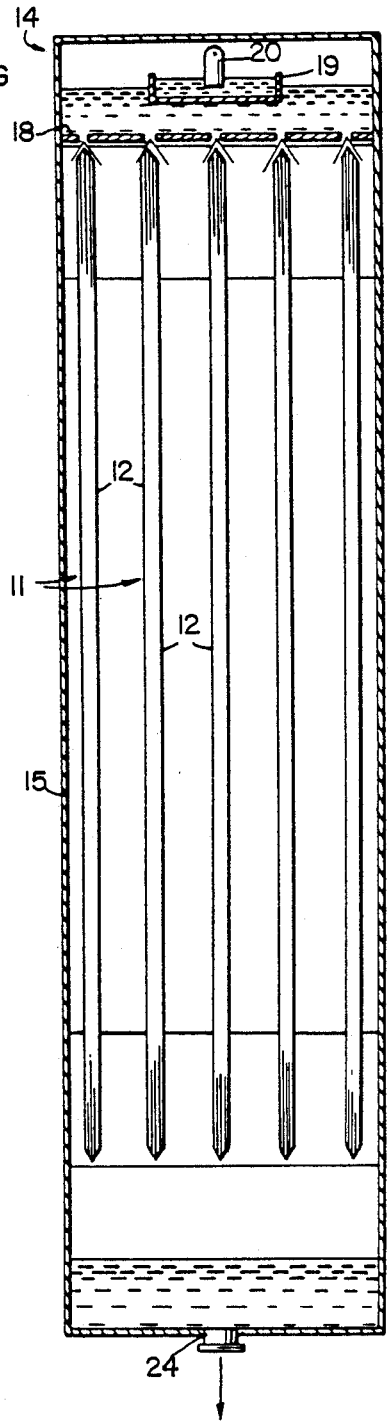
FIG. 4 is an end cut away view of the system of FIG. 3 taken perpendicular to the view of FIG. 3.

The condenser system shown in FIGS. 3 and 4 is basically similar to that shown in FIGS. 1 and 2, and indeed the illustration of FIG. 5 can be taken as a partial isometric view of the embodiment of FIGS. 1 and 2 or FIGS. 3 and 4. The only difference between the embodiment of FIGS. 3 and 4 and that of FIGS. 1 and 2 is that the air inlet duct 25*a* of the embodiment of FIGS. 3 and 4 is adjacent the lower ends of the elements 11 rather than below the ends of the elements 11, reducing the overall height of the condenser and accordingly requiring less energy for pumping water to the top of the system. In the arrangement of FIGS. 3 and 4 the air entering at 25*a* does not meet a spray of cooling water as it does in FIGS. 1 and 2, so there is some loss in heat transfer ability, which can be compensated by using more heat exchange elements 11.

The isometric illustration of FIG. 5 shows that the bottom header 27 is large enough to permit counter flow of steam entering through the nozzle 28 and condensate exiting from the interior spaces of the elements 11 through the steam entry openings 29 to leave the system via the drain pipe 35. FIG. 5 also shows the cooling water distribution system in somewhat greater detail than the preceding figures. It can be seen that the flat distribution tray 18 has a plurality of holes 40 arranged in parallel lines above the centerlines of the heat exchange elements 11. The holes 40 are shown as circular, and can be formed by drilling, but rectangular holes also work well, are less sensitive to misalignment and can be punched inexpensively with standard dies. It will also be seen that the overflow box 19 preferably has cutouts 41 in its upstanding walls for distribution of water to the holes 40 when the water from the pipe 20 overflows through the cutouts 41.

Figure 6:
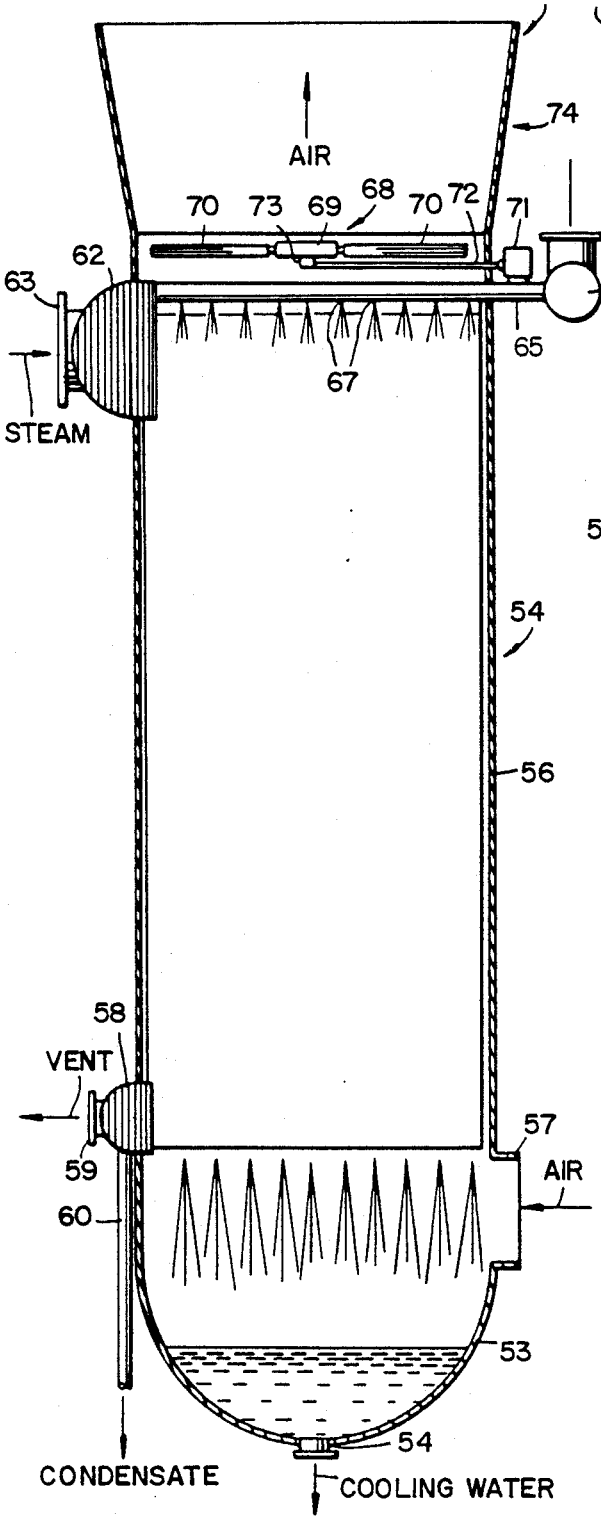
FIG. 6 is a side cut away view of a condenser system according to the invention with a cooling air exit at the top of the system and a pipe distribution arrangement for coolant liquid.
Figure 7:
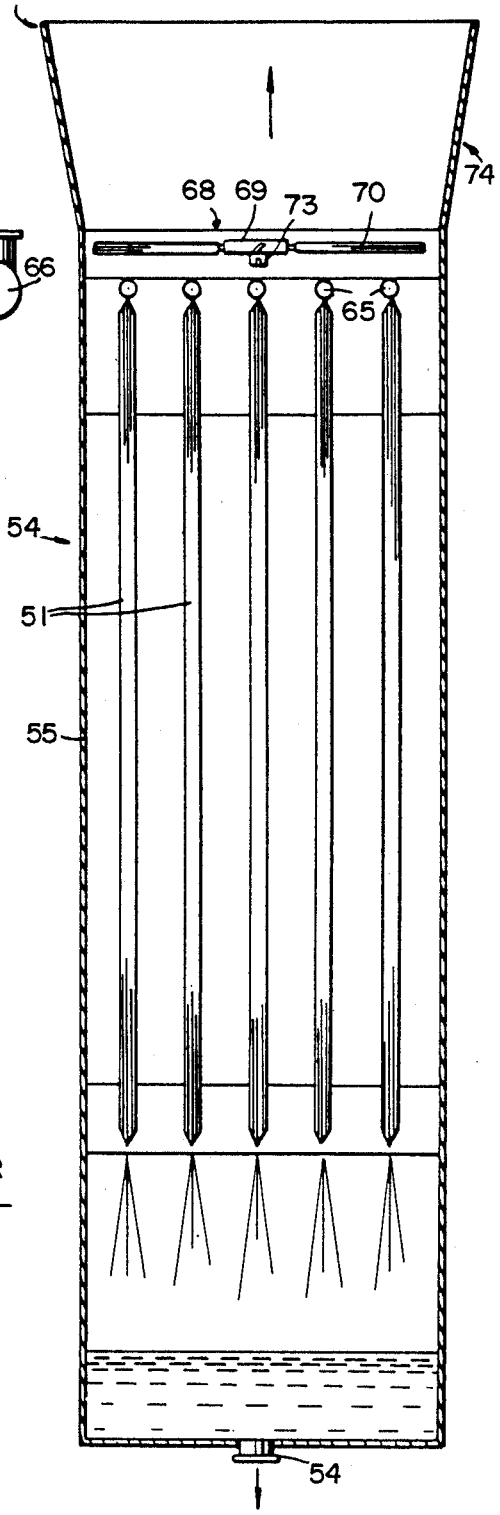
FIG. 7 is an end cut away view of the system of FIG. 6 taken perpendicular to the view of FIG. 6.

The condenser system generally designated 50 in FIGS. 6 and 7 of the drawings differs significantly from the system of FIGS. 1–5 in that heated cooling air exits at the top of the system rather than through the side as in FIGS. 1–4. The system of FIGS. 6 and 7 has a casing 54 with generally vertical walls 55 and 56 and a curved bottom wall area 53 for leading used cooling water to an outlet nozzle 54, similar to equivalent parts of the system of FIGS. 1–5. Unlike the embodiment of FIGS. 1–5, however, steam is not admitted at the bottom, but rather near the top of the apparatus, to flow generally downward while being condensed.

As shown in FIGS. 5 and 6, cooling air is fed into the system through an opening 57 which can be alongside the lower ends of heat exchange elements 51 like the opening 25*a* of FIG. 3 or below the bottoms of the heat exchange elements 51 as in the embodiment of FIG. 1 to take advantage of the cooling effect of passage of air through a spray of water falling from the heat exchange elements 51.

The heat exchange elements 51 of the embodiment of FIGS. 6 and 7 are generally similar to the elements 11 of FIGS. 1–5, being formed of pairs of plates joined about their peripheries to provide an enclosed space for condensation of steam within the elements 51 and exterior surfaces for the flow of coolant liquid as a falling film. However, the only opening near the bottom of each element 51 is an opening on to a header 58 for the escape of vent gases and condensate through the header 58 to a vent nozzle 59 and a condensate drain pipe 60 respectively as shown also in FIG. 8.

The feed of steam of be condensed to the interiors of the heat exchange elements 51 is by way of a header 62 connected to steam inlet pipe 63. The header 62 and its openings into the elements 51 are similar in structure to the header 27 described in conjunction with the embodiment of FIGS. 1–5, except that the header 62 is positioned at the upper ends of the elements 51 to feed in steam only at the top of each element 51.

Thus, in the embodiment of FIGS. 6 and 7, the steam passes downward through the elements 51, flowing in the same direction as the water film on the outside of each element 51. As in the embodiment previously described, the exchange of heat from the steam to the thin film of water condenses steam inside each element 51, and the condensate collects on the inner plate surfaces of the elements 51. The condensate runs down inside the elements 51 and exits at the bottom through the header 58 and pipe 60. In this case, however, the noncondensible substances and any uncondensed steam also exit through the header 58, passing out through the vent conduit 59.

The system of FIGS. 6 and 7 is similar to the other embodiments previously described in that the cooling effect of air is employed. Externally of the elements 51 or 11 the same processes occur in both embodiments of this invention. The air introduced through the bottom wall 53 of the casing at 57 evaporatively cools the water it encounters in moving upwards in countercurrent flow to the falling water it encounters in moving upwards in countercurrent flow to the falling water. When the air stream leaves the system through the system it will have increased the cooling capability of the water by itself cooling the water.

Since the arrangement of FIGS. 6 and 7 provides for the exit of cooling air through the top of the apparatus rather than at the side as in the previously discussed embodiments, the perforated plate system of distribution of cooling water is not employed, since such an arrangement would not permit free passage of the air. In the arrangement of FIGS. 6 and 7, instead of a perforated plate, a series of perforated pipes 65 overlie the upper edges of the heat exchange elements 51. Cooling water enters through a manifold 66 whence it is evenly distributed to all of the pipes 65. The cooling water then runs through spaced holes 67 of the pipes 65 to form a film running down the exterior surfaces of the elements 51. Using this method for distribution of coolant liquid, air passes freely out of the top of the condenser system 50. A slow speed, high volume fan 68 having a hub 69, blades 70 and driven by an electric motor 71 connected by a drive shaft 72 to a gear box 73 is preferably employed to pull air upward through and out of the condenser system. The top of the condenser system 50 is preferably formed as an upwardly widening diffusor outlet at 74 to enhance air flow.

The drive motor 71 is shown outside the diffusor outlet 74 to protect the motor from moisture carried by the exhausted air, which has evaporated some of the water it has cooled in passing up through the condenser.

It should be noted that in the embodiment of FIGS. 6 and 7 the steam inlet is at the side near the upper ends of the heat exchange elements 51 for parallel flow of steam and cooling water instead of the countercurrent flow directions for steam and water as shown in FIGS. 1–5. However, variations on both embodiments are possible for any permutation of directions of flow of air, water and steam, provided that the coolant water flows downward as a falling film. This flexibility of the system allows the user to adjust to almost any design requirements while keeping the basic structural elements of the system essentially unchanged. Thus the steam inlet to the interiors of the heat exchange elements can be at the element sides either at their tops or bottoms, or at the bottom edge of the element, the air outlet can be at the side near the top, or through the top as in FIGS. 6 and 7, or the air can be fed downwards through the system parallel to the flow of cooling water to exit at or near the bottom of the condenser. In any of these arrangements a fan can be used to force the flow of air through the system if desired.

Figure 8:
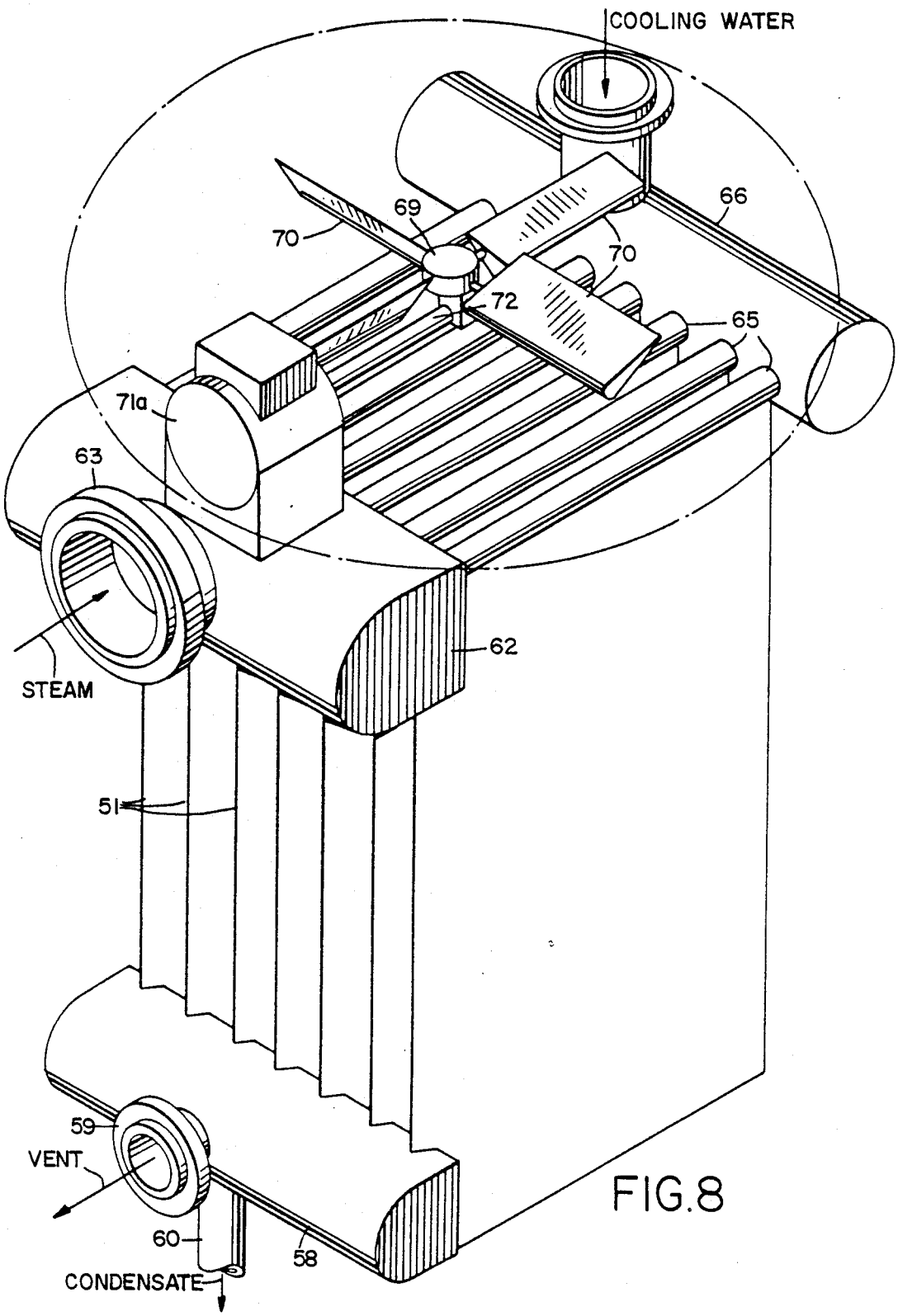
FIG. 8 is an isometric view of part of the system of FIGS. 6 and 7 with the housing omitted.

FIG. 8, like FIG. 5, shows what can be called an "element package", that is, a partially assembled condenser system which can be shipped to a user and then installed within a casing. The apparatus shown in FIG. 8 is basically similar to what has been discussed in conjunction with FIGS. 6 and 7, except for the location of the motor at 71*a*, shown in FIG. 8 as mounted on the steam header 62. This is intended to illustrate that the motor 71 can be positioned anywhere in the plane of the fan drive shaft 72 for ease of maintenance and to fit design requirements. It can also be seen that the water distribution manifold 66 is shown to be significantly larger in cross sectional area than the water distribution pipes 65 leading therefrom, to assure a uniform distribution of cooling water to all of the several pipes 65.

Figure 9:
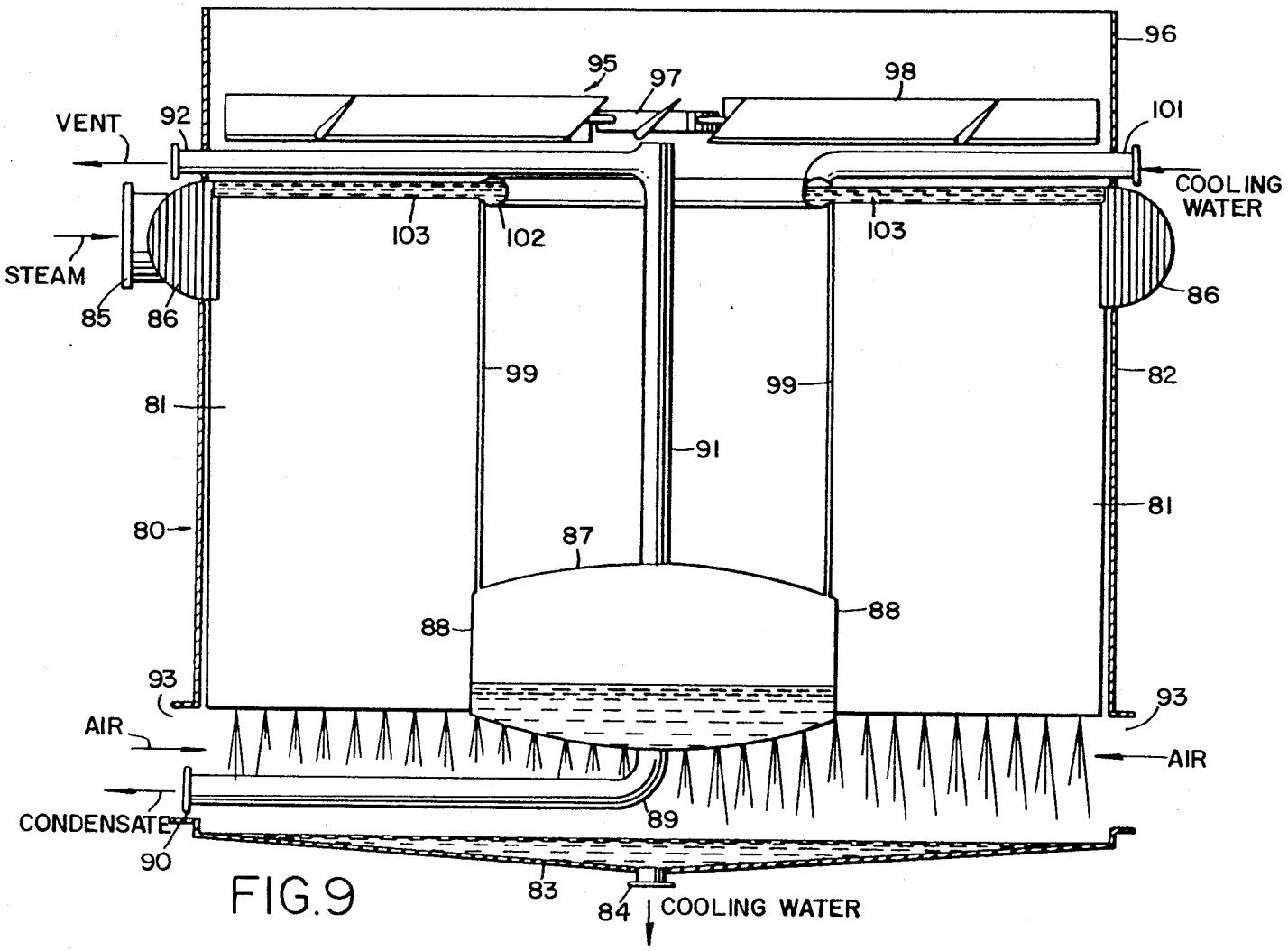
FIG. 9 is a side cut away view of a condenser system with heat exchange elements arranged radially and having a top side vapor inlet and a bottom header for condensate and vent gases which are led out respectively at the bottom and top of the system.
Figure 10:
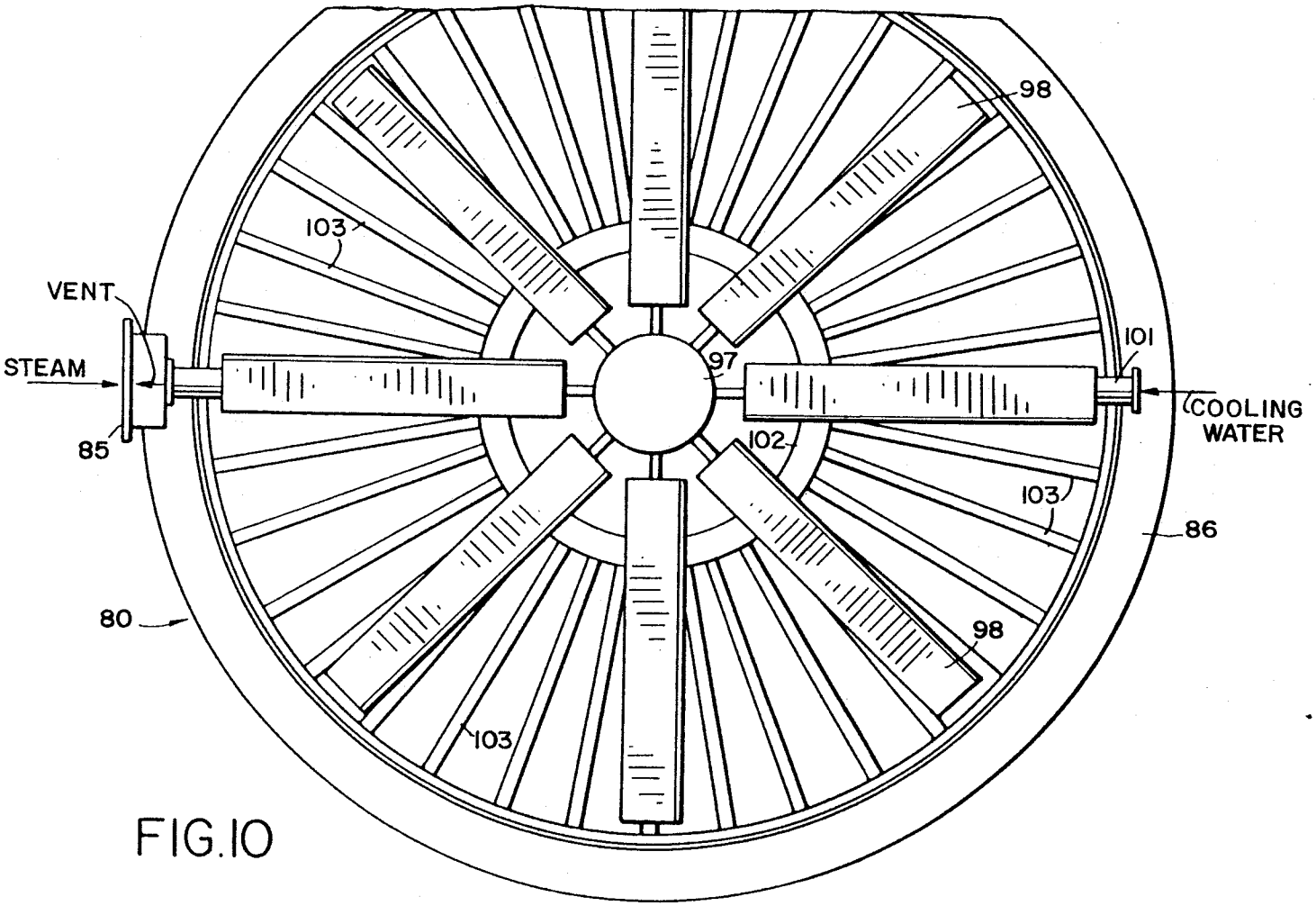
FIG. 10 is a top view of the radial system of FIG. 9.
Figure 11:
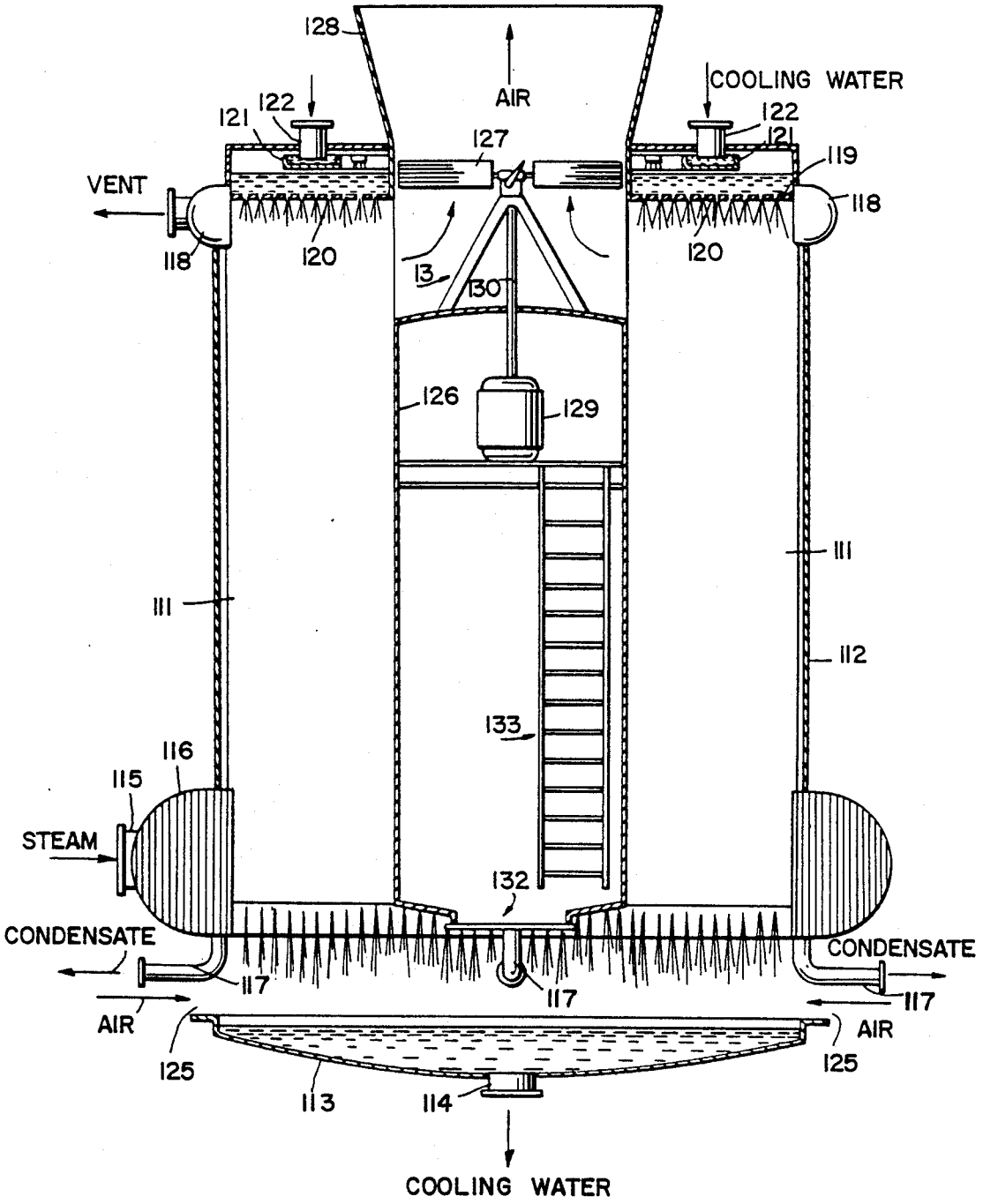
FIG. 11 is a side cut away view of a radial condenser system with a perforated plate distribution arrangement for coolant liquid and a bottom side vapor inlet arrangement.

The embodiments of FIGS. 9, 10 and 11 depart from the parallel heat exchange element structure of the previously described embodiments, while individually quite like the elements 11 and 51 already described, are arranged in a radial configuration.

Like the embodiment of FIGS. 6 and 7, the apparatus shown in FIGS. 9 and 10 provides for the exit of cooling air from the top of the system. The condenser of FIGS. 9 and 10, generally designated by the reference numeral 80, has a plurality of heat exchange elements 81 formed by pairs of rectangular plates joined together around their peripheries like the heat exchange elements 11 and 51 already described. The casing 82 of the condenser system 80 is generally cylindrical, with a downwardly concave disk like floor 83 having a central drain 84 for the discharge of coolant water which has passed over the heat exchange element 81 as a falling film.

Within the casing 82, the upright heat exchange elements 81 are in a radially extending array, equally arcuately spaced like the spokes of a wheel.

Steam is introduced into the interior spaces within the heat exchange elements 81 through a steam inlet 85 connected to a steam header 86 extending around the circumference of the casing 82 near the tops of the heat exchange element 81, which have openings on to the header 86 like the steam inlet openings 29 shown in FIG. 5. The steam condensed within the heat exchange elements 81 by the heat transfer to the cooling water, and the vent gases not condensed, exit from the elements 81 into a common central chamber 87 opening on to the lower inside edges of the elements 81. A condensate drain pipe 89 leads from the center of the chamber 81 downward and out of the casing 82 as shown at 90 in FIG. 9. An upwardly extending conduit 91 leads vent gases from the central chamber 87 to a point above the tops of the elements 81 and thence generally horizontally out of the casing to a vent outlet 92. The vent outlet conduit 91, 92 does pass across the area through which cooling air flows upward, but because of the relatively small dimensions of the conduit, the interference with air flow is minimal.

The cooling air enters from the sides below the array of heat exchange elements 81 as shown by the openings 93 to contact the water streaming off the heat exchange surfaces 81 in a manner similar to that of the embodiment of FIGS. 1 and 2, and the air then passes upward, cooling the falling water film by evaporation. A large fan 95 operating at low speed with high volume action draws the cooling air upward to a space enclosed by the generally slightly conical diffusor wall 96. The fan 95 has a hub 97 and blades 98 as shown in FIGS. 9 and 10.

Separating the central area of the condenser system 80 from the area through which air and water flow between and over the heat exchange elements is an upstanding cylindrical wall 99 which prevents the cooling air from entering the central part of the system, so that the cooling air must flow between the heat exchange elements 81.

Since the embodiment of FIGS. 9 and 10 has air exiting at the top, the distribution system for cooling water must not block air flow. Accordingly, coolant water enters through an inlet 101 to a circular coolant water manifold 102 located inwardly at the upper end of the barrier wall 99, and the water is distributed to the surfaces of the heat exchange elements by a plurality of perforated pipes 103, one pipe 103 being arranged above the upper edge of each element 81 in a manner generally similar to that illustrated in the parallel plate arrangements of FIGS. 6 and 7.

After flowing over the elements 81 the cooling water falls as a spray into the collection area defined by the bottom wall 83, meeting the incoming air. It will be noted that the condensate drain pipe 89 is exposed to the incoming cooling air, which further cools the condensate therein. If desired, the pipe 89 could be finned to enhance cooling of the condensate.

It will be noted that in the radial arrangement of FIGS. 9 and 10, the distance between adjacent heat exchange elements 81 increases with the distance from the vertical centerline of the condenser 80 because the elements 81 are themselves of substantially uniform thickness throughout their widths from inner to outer edge. However, the difference in air velocity between the inner and outer edges of the heat exchange elements is not significant in a large condenser system according to this embodiment of the invention.

Like the system of FIGS. 9 and 10, the embodiment of FIG. 11 has a radial array of heat exchange elements 111 formed by pairs of rectangular plates joined around their edges. The system of FIG. 11 has a cylindrical outer casing 112, a dish-like water collecting bottom wall 113 and a coolant water discharge outlet 114. Unlike the radial arrangement of FIGS. 9 and 10, the condenser of FIG. 11 has a bottom side stream inlet arrangement, with steam to be condensed entering through the inlet 115 and passing through an annular bottom steam header 116 to the interiors of the plurality of heat exchange elements 111 in a manner similar to that shown in FIGS. 1–5. Condensate formed within the heat exchange elements 111 exits to the steam inlet header 116 and is discharged through pipes 117. Noncondensible and vent gases leave the interior spaces of the heat exchange elements 111 through a circumferential header 118 which communicates with openings at the upper outside edges of the elements 111 like the header 31 of FIG. 5.

The cooling water distribution system of the embodiment of FIG. 11 is similar to that of FIGS. 1–5 adapted to the radial arrangement of head exchange elements 111. There is an annular perforated plate 119 arranged above the tops of the heat exchange elements 111 to deliver a uniform flow of water to the element surfaces through perforations 120. Water is distributed to the perforated plate from a ring-shaped overflow box 121 generally similar to the overflow box 19 of the embodiments of FIGS. 1–5 except that the box 121 has an annular form. Water is fed to the overflow box 121 through inlet nozzles 122.

The cooling water overflows cutouts (not shown in FIG. 11) of the box 121 on to the perforated plate 119 whence it falls out holes 120 aligned with the heat exchange elements 111. The cooling water then flows down the full length of the elements 111 and drops in the form of a shower to be collected in the sump formed by the floor 113 whence it exits through the drain 114.

Cooling air enters through the ducts 125 below the elements 111 where it encounters the shower of water. The air is then drawn up between the elements 111, cooling the water by evaporation. An inner cylindrical wall 126 extending upward most of the height of the elements 111 ends below the tops of the elements 111, allowing the air to be drawn radially inward and upward by the fan 127 as shown by the arrows in the drawing, to be exhausted to the atmosphere through the diffuser 128.

It will be seen that the inner wall 126 encloses a compartment for a motor 129 that drives the fan 127 through drive shaft 130. Support structure for the fan 127 is shown at 131. A manhole 132 and ladder 133 allow personnel to enter within the inner wall 126 for inspection and maintenance.

The radial embodiments of the invention of FIGS. 9–11 can have one or more air inlets, condensate and vent outlets, etc. It should also be noted that, as in the other embodiment of the invention steam can be fed into the heat exchange elements at or near their bottoms, through the sides or at the top of the elements, and air and cooling water can flow concurrently or countercurrently, although not all of the permutations have been illustrated in the drawings.

Figure 12:
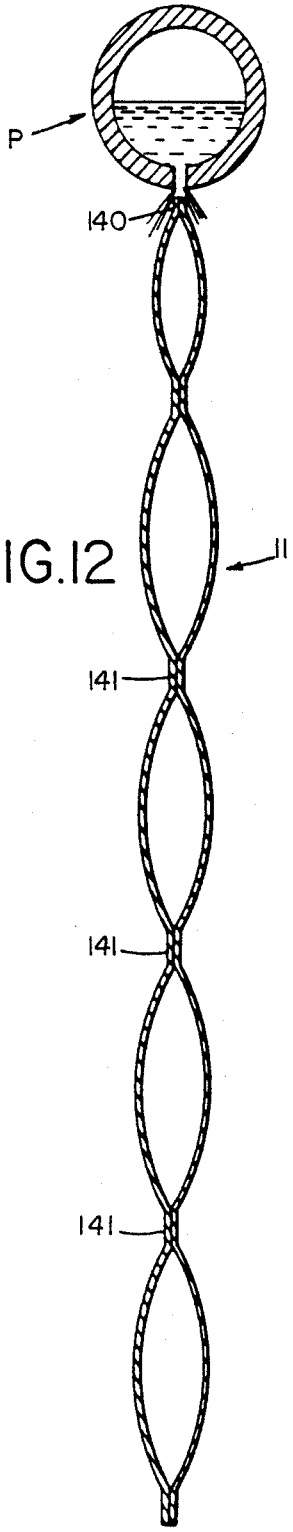
FIG. 12 is a detail view showing a pipe system of coolant liquid distribution for exit of cooling air at the top of the system.
Figure 13:
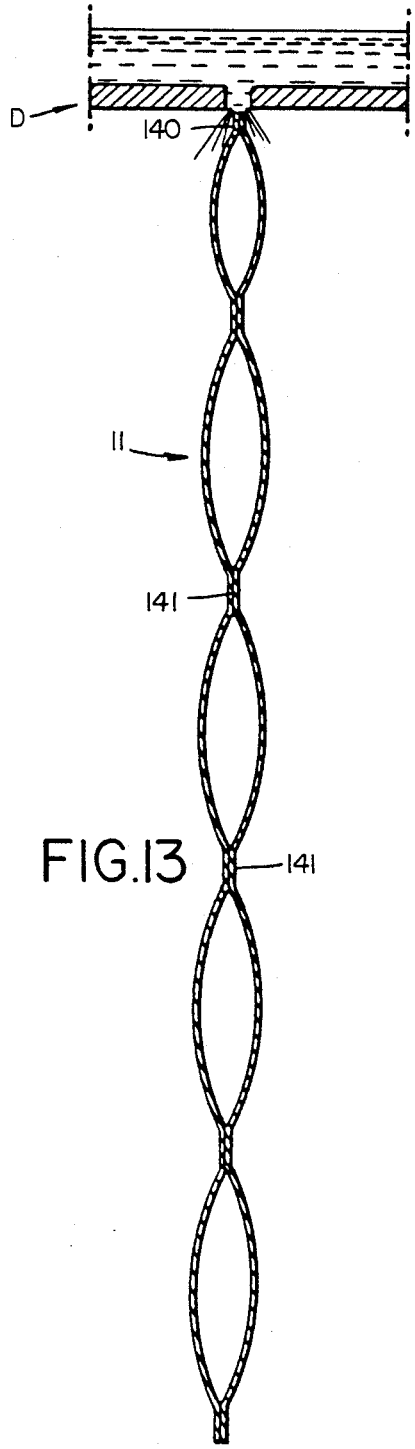
FIG. 13 is a detail view of a perforated plate system of distribution of coolant liquid for use in systems according to the invention wherein air exits at the side of the system.

FIGS. 12 and 13 illustrate the two preferred types of water distribution, as well as details of the heat exchanger elements, identified by number 11 in these drawing figures. The elements 11 are formed of two generally rectangular plates 12 usually of steel, welded together at their edges as shown at the top edge, and spot welded at spaced locations 141, and can be made in accordance with my prior U.S. Pat. No. 3,512,239 or U.S. Pat. No. 3,736,783. In FIG. 12, the pipe P, which could be the pipe 103 of FIG. 9 or 65 of FIGS. 6–8 has spaced holes for distributing water from the pipe interior to the top edge 140 of the element 11 whence the water spreads itself evenly to fall as a film. The spaced dimples formed by the spot welds 141 prevent channelling of the water flow down the plates of the element 11.

In FIG. 13, the perforated distribution plate D has holes for the discharge of cooling water to the element 11 as in the embodiments of FIGS. 1–5 and 11.

It should also be understood that the condensate, vent gases and noncondensibles discharges from the condenser can be subjected to further treatment as desired, and the cooling water discharged can be reused.

In all of the previously described embodiments of the invention in which coolant air flows upward through the condenser in counter-current flow to the coolant liquid, performance can be enhanced by the detachment and entrainment of droplets of the coolant liquid.

Figure 14:
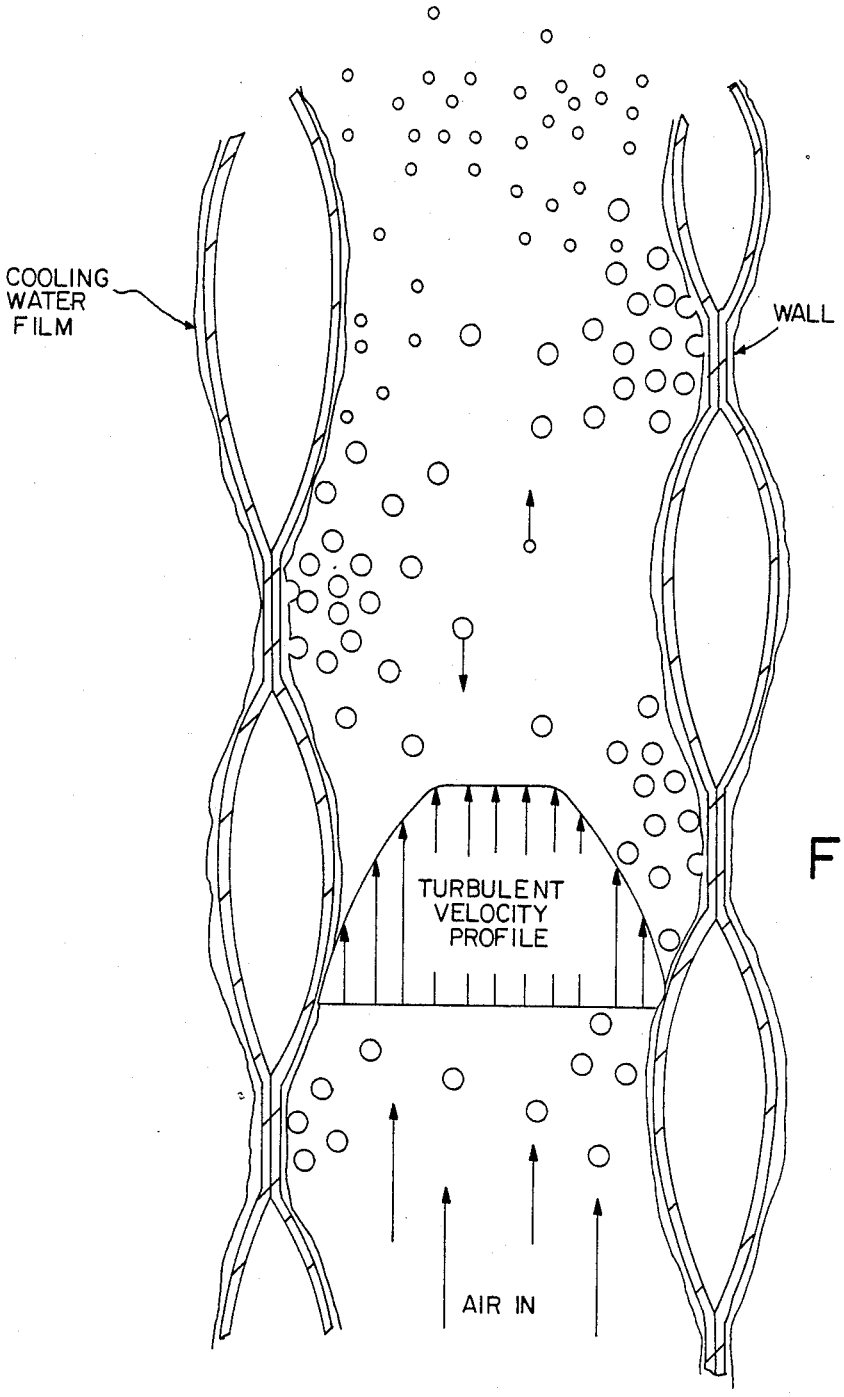
FIG. 14 schematically shows the detachment of droplets from a film flowing down dimpled plates to form a fluidized bed of suspended droplets.
Figure 15:
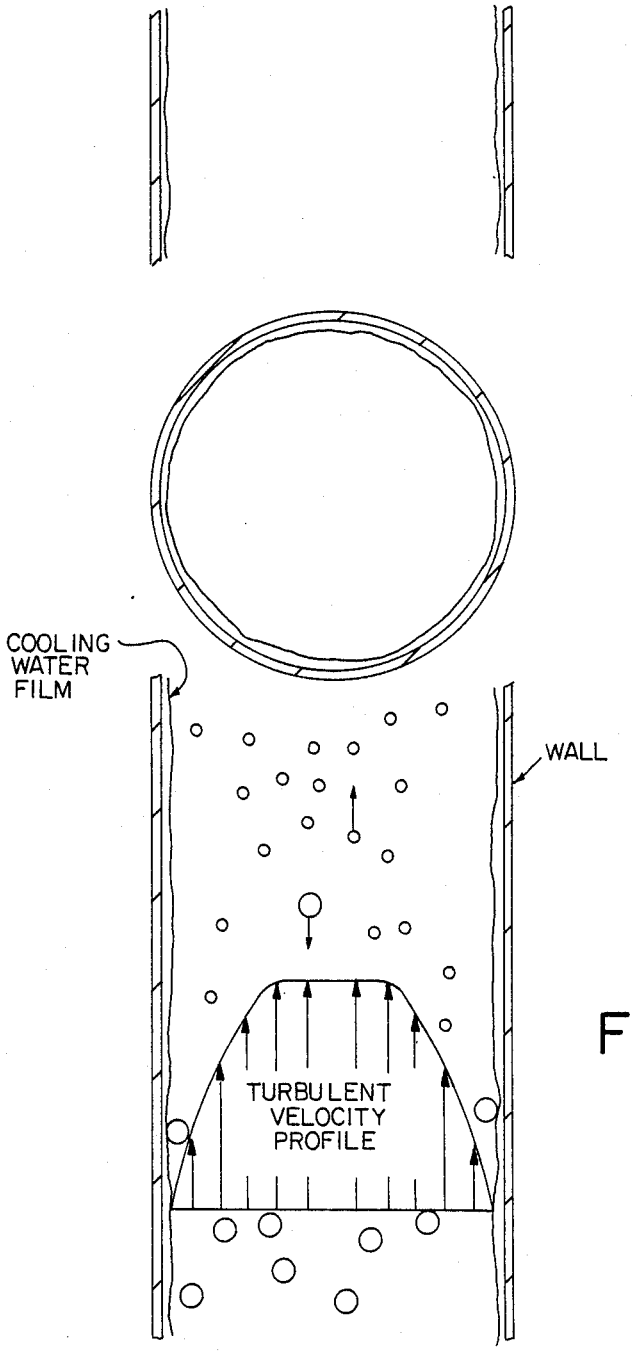
FIG. 15 schematically indicates how droplets can be formed from a film falling within a tube in a vertical tube condenser to increase heat exchange.

Such entrainment, as schematically illustrated in FIGS. 14 and 15, does not appear to adversely affect the cooling action of the falling film which continues to flow as a film down the plate surfaces, but rather it enhances cooling by mass transfer between the falling film and the cooling air. Film continues to fall down the entire length of the heating surface as described earlier.

In order to achieve this droplet entrainment the rate of flow of cooling air must be sufficiently rapid to detach droplets, and lift them. This phenomenon can be viewed as occurring through the formation of waves in the falling film, and the growth of such waves until they bridge the channel between opposed plate surfaces, thus producing splashing by interrupting air flow; or alternatively, as the simple entrainment of individual droplets. Whatever the actual details of the physical process of droplet formation are, experiment has shown that with a sufficient rapid upward air velocity, droplets form. In experiments performed using air as the gaseous coolant and water as the liquid coolant at atmospheric pressure, in a condenser according to the invention the limiting air velocity for droplet entrainment is approximately 52 feet/second. Of course, at different pressures, or using different cooling media, the limiting velocity may change, but it is simple to vary the velocity of upward flow until optimum conditions are reached, for example, by varying the rotational speed of a fan such as the fan 68 of FIGS. 6–8 or the fan 95 of FIGS. 9 and 10.

The droplets formed and entrained are relatively large in size compared with water droplets in a mist, being about 100 times larger than mist droplets. A mist would simply be blown upward and out of the condenser. Note that too small a droplet will rise upward as shown by the arrow in FIG. 14, while a larger droplet will descend against the upward drag of the air, as shown at the left in FIG. 14. Water droplets entrained in experimental operation were about 2 mm. in diameter.

Although the present invention is principally concerned with plate element condensers, which are more desirable for several reasons than condensers which employ vertical tubes as their heat exchange surface, the same droplet-formation phenomenon could be produced in a vertical tube condenser with a counter-current flow, as indicated in FIG. 15.

While in the past it has not been thought desirable to disturb the even flow of a thin film of coolant liquid on a condenser surface, it has now been surprisingly found that separation and entrainment of liquid droplets from the film enhances heat exchange and thus increases the efficiency of condensation, making possible the use of smaller condensers, without resorting to expensive increases in the heating surface area of the condenser.

In short, the creation of a fluidized bed of suspended droplets of liquid coolant in a countercurrent flow of air improves the performance of a falling film condenser.

Figure 16:
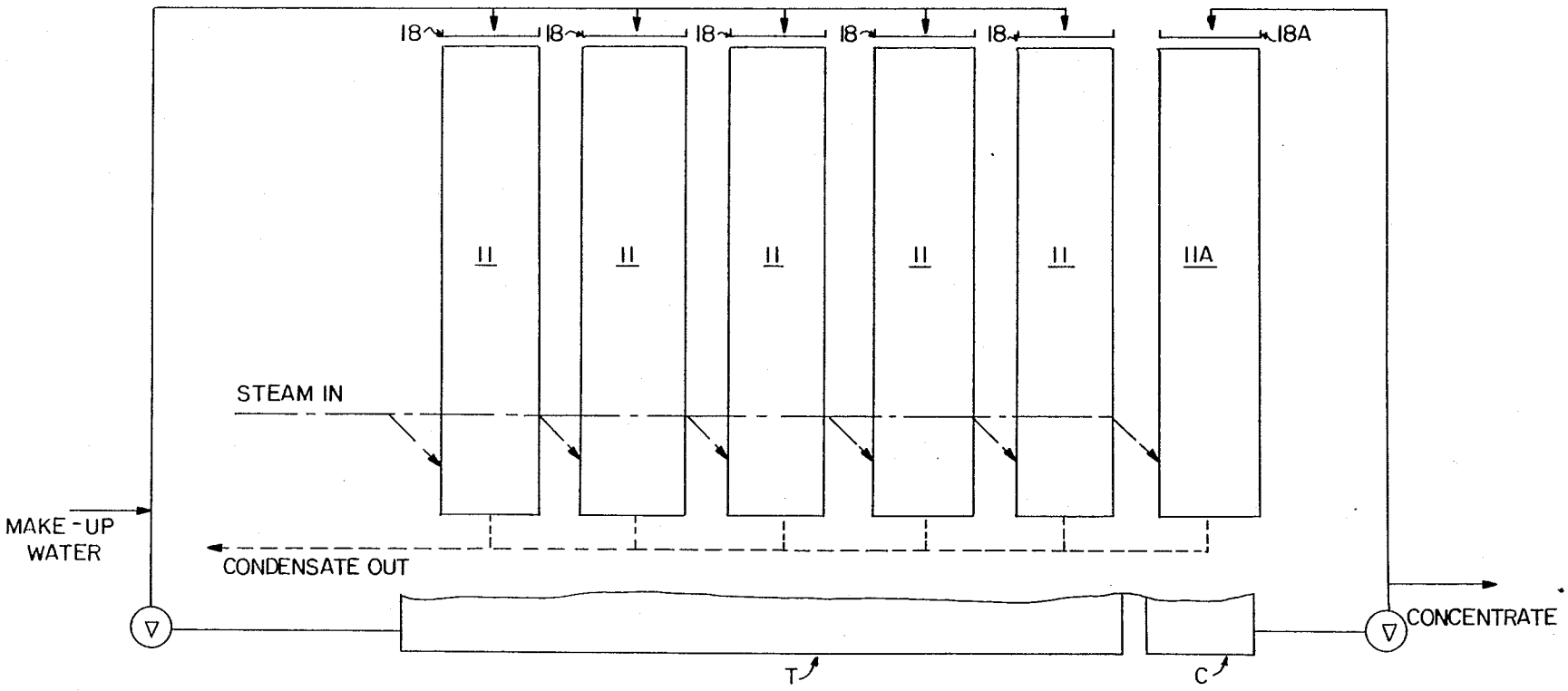
FIG. 16 is a schematic view showing the blow down concentrator and its relationship with other parts of the evaporative condenser system.

FIG. 16 schematically illustrates a number of the plate elements 11 as already described to which coolant water is fed through the trays 18 positioned above the elements 11. At the right of the drawing there is shown an element designated 11A, associated with a liquid distribution tray 18A. The element 11A and tray 18A can be of the same structure as elements 11 and trays 18.

As shown in FIG. 16, the source of coolant water for the elements 11 is the same, and the water which has passed over the surfaces of the elements 11 can be collected in the common collecting tank T. Some of the cooling water will have evaporated in the course of passing over the heating surface of the elements 11, so fresh make-up water must be provided as illustrated. This replenishment keeps the water quality good enough so that scaling or build-up of deposits on the surfaces of elements 11 is controlled.

An amount of water, equivalent to the make-up water supplied, flows from the collector basin T to the tank or basin C located beneath the element 11A, whence this somewhat contaminated water is circulated, by means of a pump as shown, to the tray 18A, from which it passes, in the usual fashion to flow down the surfaces of the element 11A. Evaporation in the course of passage over element 11A concentrates the liquid, which drops to collecting tank C. Some of this concentrate is removed from the system as shown at the lower right in FIG. 16.

A pump for circulating relatively clean water from the tank T, along with added make-up water, is shown at the lower left in FIG. 16. This water goes to trays 18 as the evaporative coolant for steam fed into the elements 11, while the water from collecting tank C serves as coolant for the element 11A. The flow of water from tank T to tank C can, if desired, be controlled by valve means (not shown) or a pump (not illustrated) providing a sufficient supply of water to the tray 18A and element 11A.

It may be noted that although the elements 11 and 11A are shown as individual units, they can, in practice, be banks of plate heating elements, as illustrated, for example, in FIG. 2. The concept is to integrate a concentrator for the used coolant into an evaporative condenser. All of the apparatus shown in FIG. 16 can be enclosed in a common housing, which is omitted from the drawing for simplicity, just as other details already illustrated in other drawing figures are omitted from FIG. 16, but those familiar with the art will understand the simplified illustration of FIG. 16, especially in view of the foregoing detailed description of the other drawing figures.

Numerous variations, modifications and adaptations of the condenser system according to the invention, such as, for example use with other media than air and water, will suggest themselves to those acquainted with heat exchange technology, and are considered to be within the spirit and scope of the invention.

What is claimed is:

1. A falling film air-cooled surface condenser comprising: a casing, a plurality of plate heat exchange elements having generally vertical surfaces within said casing, said plate heat exchange elements being spaced to provide channels therebetween for vertical air flow, each of said plate heat exchange elements comprising a pair of spaced, substantially flat dimpled plates joined at their peripheries, as well as at regularly spaced dimples, and each said element having a bottom inlet for vapor and a top outlet for vent gases vertically spaced from said inlet, header means for introducing vapor to be condensed into said elements comprising a transverse header opening on to the bottom inlet of each of said elements; bottom header means for discharging condensate from said elements; and upper transverse header means communicating with an upper end of each element for withdrawing vent and non-condensible gases from said elements; apertured tray means for distributing coolant liquid on to said element surfaces to flow as a falling film thereon; and means for passing a stream of cooling air upwards around said heat exchange elements within said casing to detach droplets of said liquid coolant from said film and to suspend such detached droplets to cool the coolant liquid by direct heat transfer with said film and by mass transfer between the film and the cooling air, at least one of said plate heat exchange elements having means for distributing thereto, as coolant, liquid which has been passed over the surface of another element whereby the concentration of solids in the liquid distributed to said at least one of said plate heat exchange elements is increased, and including tank means for collecting liquid with an increased concentration of solids and removing said liquid from circulation.

2. An improved method for condensing vapor in a falling film air-cooled surface condenser and concentrating coolant liquid before discharging said liquid comprising introducing vapor to be condensed into bottom portions of interior spaces of falling film heat exchange elements having generally vertical dimpled surfaces, causing the vapor to be condensed to flow upwards in a generally vertical direction within said heat exchange elements, causing coolant liquid to flow as a falling film down said external surfaces to cool and condense the vapor within said interior spaces, causing cooling air to flow upwards through vertical channels between said heat exchange elements in contact with the film to cool the liquid of the film, and to detach droplets of coolant liquid from said film and to suspend such detached droplets for cooling by direct heat transfer with said film and by mass transfer between the film and the cooling air and withdrawing vent and non-condensible gases through a transverse header from upper portions of said interior spaces and employing at least one of said heat exchange elements as a concentrator by causing liquid which has passed over another of said elements to flow over said at least one of said heat exchange elements.

3. The method of claim 2 wherein the air is unsaturated with the liquid of the film and cooling of the film is by evaporation.

4. A surface condenser comprising a plurality of spaced heat exchange elements, each said element including a pair of spaced, upright plates joined together at the plate peripheries, as well as at regularly spaced dimples throughout the plate areas, a housing enclosing said heat exchange elements, bottom inlet means for introducing steam into the spaces enclosed between said pairs of plates to flow upwards therebetween, means for distributing water to flow as a thin film down the exterior surfaces of said plates for the exchange of heat from the steam to the water film through the plates, means for passing a stream of cooling air upwards through vertical channels between said spaced heat exchange elements from an air inlet at or near the bottom of said housing to an air outlet above the heat exchange elements at a rate of flow rapid enough so that the flow of air countercurrent to the flow of the film of water serves to cool the water film by evaporation and also cools the water film by mass transfer by detaching and suspending droplets from said film, an outlet for condensate at or near the bottom of each element, and an outlet for vent gases at or near the top of each element, at least one of said elements serving to concentrate liquid which has passed over the surface of another of said elements, and including means for circulating such liquid to said at least one element and means for removing liquid concentrate.

5. The surface condenser of claim 4 wherein the means for distributing water comprises perforated horizontal plates spaced above the heat exchange elements, having perforations arranged in rows aligned with the elements for distribution of water to form the film.

6. The surface condenser of claim 4 wherein the housing has generally vertical side walls, and inwardly curving lower side walls terminating in a bottom outlet for the discharge of water, said air inlet for the cooling air through the side wall below the heat exchange elements so that the cooling air flows upwards along the entire height of the heat exchange elements.

7. The surface condenser of claim 4 wherein said heat exchange elements are in spaced, generally parallel relationship.

8. The surface condenser of claim 4 wherein said heat exchange elements are radially arranged and equally arcuately spaced apart, said housing being generally cylindrical.

9. The surface condenser of claim 4 and including a fan for forcing said stream of air through said housing.

* * * * *

UNITED STATES PATENT AND TRADEMARK OFFICE

CERTIFICATE OF CORRECTION

PATENT NO. : 4,969,507

DATED : November 13, 1990

INVENTOR(S) : Axel E. Rosenblad

It is certified that error appears in the above-identified patent and that said Letters Patent is hereby corrected as shown below:

ON THE TITLE PAGE

"Related U.S. Application Data" has been omitted as follows:

--Related U.S. Application Data

[63] Continuation-in-part of Ser. No. 788,675, Oct. 17, 1985; abandoned, which is a continuation of Ser. No. 626,481, July 2, 1984; abandoned, which is a continuation of Ser. No. 408,290, Aug. 16, 1982; abandoned, which is a cont. of Ser. No. 047,681, June 12, 1979, abandoned, which is a cont. of Ser. No. 811,615, June 30, 1977; abandoned.--.

Signed and Sealed this

Twenty-first Day of April, 1992

*Attest:*

HARRY F. MANBECK, JR.

*Attesting Officer*

*Commissioner of Patents and Trademarks*